US006027091A

United States Patent [19]

Johnson

[11] Patent Number: 6,027,091

[45] Date of Patent: Feb. 22, 2000

[54] CURTAIN CLIP

[76] Inventor: Scott A. Johnson, 14203 NE. 73rd St., Redmond, Wash. 98052

[21] Appl. No.: 09/024,674

[22] Filed: Feb. 17, 1998

[51] Int. Cl.[7] ..... B42F 13/00

[52] U.S. Cl. ..... 248/340; 248/228.1; 52/39

[58] Field of Search ..... 248/72, 73, 74.2, 248/228.1, 228.7, 230.7, 231.81, 316.7, 254, 262, 267, 340, 343; 52/39, 222, 506.07

[56] References Cited

U.S. PATENT DOCUMENTS

| | | | |
|---|---|---|---|
| 2,652,586 | 9/1953 | Ramsberger . | |
| 2,787,435 | 4/1957 | Shields . | |
| 3,199,142 | 8/1965 | Salzmann et al. . | |
| 3,213,926 | 10/1965 | Seckerson . | |
| 3,497,905 | 3/1970 | Pflum . | |
| 4,112,550 | 9/1978 | DeWitt et al. . | |
| 4,200,171 | 4/1980 | Seymour et al. . | |
| 4,221,355 | 9/1980 | Hoop . | |
| 4,223,488 | 9/1980 | Schoenung . | |
| 4,290,575 | 9/1981 | Swartwout | 248/316.7 |
| 4,315,611 | 2/1982 | Hoop . | |
| 4,564,165 | 1/1986 | Grant et al. | 248/343 |
| 4,759,087 | 7/1988 | Zeilinger . | |
| 4,765,039 | 8/1988 | Rowlands et al. | 24/556 |
| 5,058,340 | 10/1991 | Muller | 52/222 |
| 5,490,651 | 2/1996 | Kump | 248/231.81 |
| 5,863,019 | 1/1999 | Rose et al. | 248/205.3 |

*Primary Examiner*—Ramon O. Ramirez
*Assistant Examiner*—Gwendolyn Baxter
*Attorney, Agent, or Firm*—Christensen O'Connor Johnson & Kindness PLLC

[57] ABSTRACT

A curtain clip device (10) includes a top flange portion (14) with two inwardly directed channels (16) and (18) bounding of the upper surface (20) of the top flange portion (14). The inwardly directed channels (16) and (18) partially enclose the upper surface (20) of the top flange portion (14) to form a recess (24) sized to receive a support structure. A diagonally downward extending lever (26) protrudes from the outside lower corner of adjacent channel (18). Rotation of the lever (26) causes the top flange portion (14) to be flexed, allowing the clip device (10) to engage with a support structure. A curved lower jaw (30) depends downward from the lower surface (22) of the top flange portion (14) and has a free end (32) configured to form a jaw clasp (34). A stationary clasp (36) depends from the lower surface (22) of the top flange portion (14), which is designed to selectively mate in an interlocking configuration with the jaw clasp (34) of the curved lower jaw (30) thereby securing a protecting curtain. The curved lower jaw (30) further contains an outwardly directed channel (38) opposite the jaw clasp (34) for receiving a leverage tool to assist in unlatching the jaw clasp (34) from the stationary clasp (36).

14 Claims, 4 Drawing Sheets

CURTAIN CLIP

FIELD OF THE INVENTION

The present invention relates to an implement composed of a clip-type device, and more particularly to a device for hanging curtain type material from the framework used to support ceiling tiles.

BACKGROUND OF THE INVENTION

It is frequently desirable to temporarily hang protective curtains inside buildings in many different instances, such as during interior construction, remodeling, and painting. At the present time, there is no satisfactory way to accomplish supporting protective curtains in this manner. This is largely due to the fact that these buildings are usually devoid of any adequate supporting structures for the curtains. A possible method for suspending articles in this situation, incorporates utilizing the horizontal beams which support acoustical ceiling tiles.

There have been attempts in the prior art to produce devices that will suspend various articles from ceiling support beams. . These include U.S. Pat. No. 4,112,550 (DeWitt et al.) and U.S. Pat. No. 4,315,611 (Hoop), both of which disclose suspended hooks that will attach to ceiling support beams and facilitate the hanging of objects from their lower hook portions. These devices are ineffective however, in providing a means for supporting a temporary protective curtain from a ceiling structural member, in that a hook will not efficiently anchor to the sheet configuration of a curtain.

Although some type of jerryrigging might possibly be conceived to hang a curtain from a hook, this would not only be impractical, but would also likely produce tearing of the curtain and/or excessive gapping between the curtain and the ceiling. Thus, there is a continuing need for a simplified device that will effectively suspend a temporary curtain from a support structure, and is also relatively easy to install and operate.

SUMMARY OF THE INVENTION

The present invention teaches a clip type device including a top flange portion with two inwardly directed channels at the ends of the top flange portion's upper surface. The inwardly directed channels partially enclose the top flange portion's upper surface to form a recess such that a support structure is receivable into the recess. A lower jaw portion extends downward from the lower surface of the top flange portion and has a free end configured to form a jaw clasp. A stationary clasp depends from the lower surface of the top flange portion, which is designed to selectively mate in an interlocking configuration with the jaw clasp of the lower jaw portion. The free end of the lower jaw portion further contains an outwardly directed channel to assist in unlatching the jaw clasp from the stationary clasp.

In a preferred embodiment of the present invention, the inwardly directed channels of the top flange portion are sized to engage with a standard 15/16 th inch ceiling t-grid. The top flange portion further contains a diagonally downward extending lever which is incorporated into the outside lower comer of one of the inwardly directed channels. This lever has a serrated or otherwise textured upper surface to facilitate manual activation of the lever. The purpose of the lever is to rotate the attached inwardly directed channel when desiring to attach or detach the clip device from the ceiling support t-grid. The lower jaw portion of the clip is designed such that the jaw clasp of the lower jaw portion and the stationary clasp of the top flange can close over a thin fabric or plastic curtain and secure it in place, using only finger pressure. The outwardly directed channel can be used to unlatch the jaw clasp from the stationary clasp through insertion of a release tool, such as a screwdriver blade, thus allowing repetitive use of the clips.

In an alternate embodiment, the clip device is similar to the clip of the preferred embodiment, except that the inwardly directed channels of the top flange portion are sized to engage with a standard 9/16 th inch ceiling t-grid.

In an additional alternate embodiment, the top flange portion of the clip device does not have inwardly directed channels at its ends, but instead is substantially flat. Further, the top flange portion of the clip also does not contain a downwardly extending lever. A clip of this alternate embodiment is designed to be mounted on a vertical wall, with the substantially flat surface of the top flange portion adhered to a vertical wall. The lower jaw portion, the jaw clasp and the stationary clasp of this alternate embodiment function in the same manner as the preferred embodiment.

A clip device constructed in accordance with the present invention may thus be simply, inexpensively, and effectively used to temporarily suspend thin protective curtains from standard ceiling supports. The device is constructed such that the top flange portion can be easily released from a ceiling support t-grid, and such that a secured curtain can be easily released from the selectively mateable jaw clasp and stationary clasp. Thus, the clip device is fully adjustable and reusable, requiring only a screwdriver blade or similar instrument for detachment and reuse. Alternate embodiments of this invention provide correspondingly sized clips for varying standard ceiling support t-grids, and additionally provide a vertical wall mounting embodiment for situations where ceiling support t-grids do not exist or are otherwise unavailable.

BRIEF DESCRIPTION OD THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
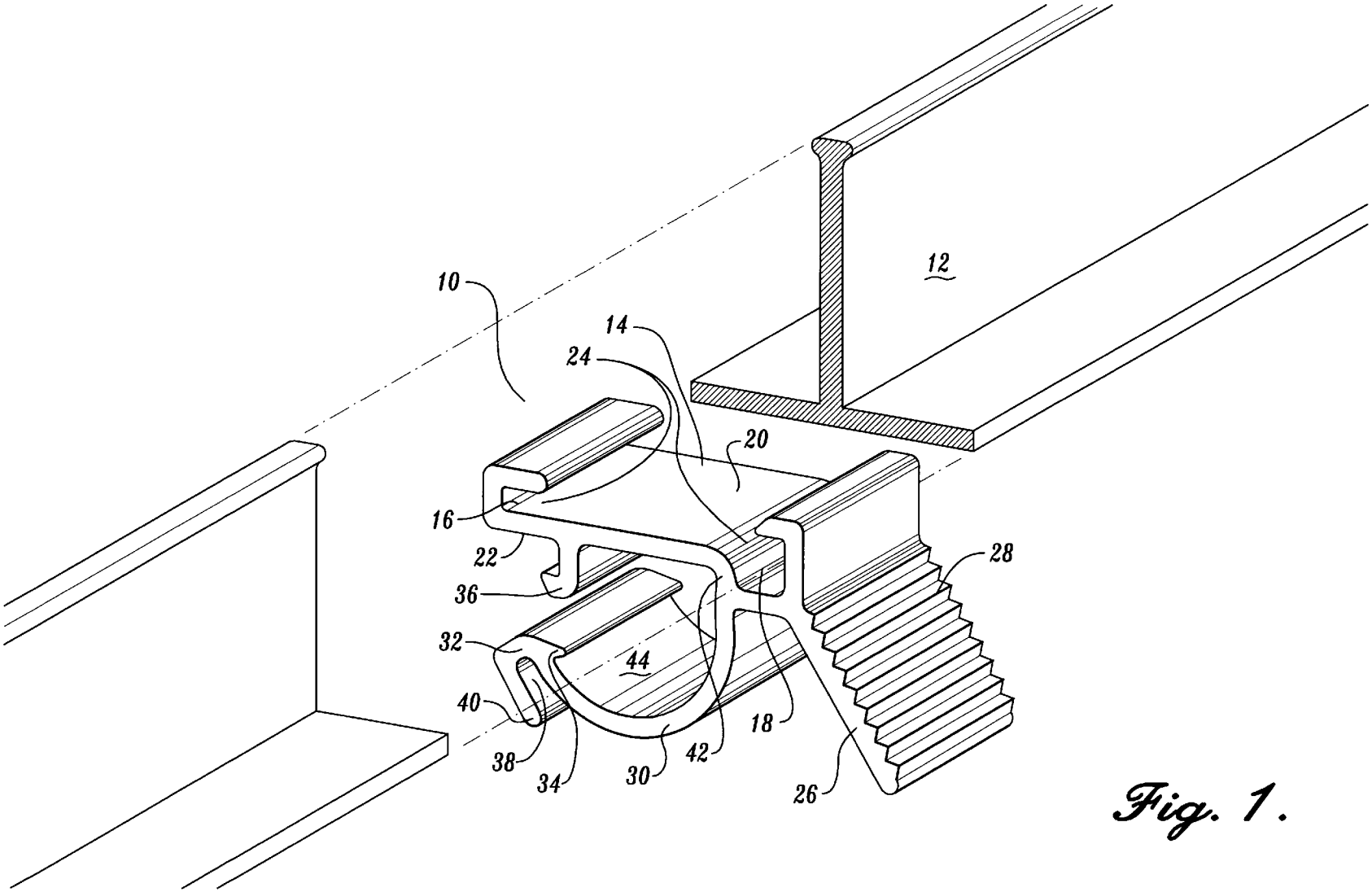
FIG. 1 illustrates an enlarged perspective view of a preferred embodiment of the present invention and a ceiling support structure t-grid, with a section of the ceiling support structure t-grid shown in phantom.

FIG. 1 illustrates a preferred embodiment of a curtain clip device 10 constructed in accordance with the present invention and mounted to the lower flange of a t-grid ceiling support 12. The clip device 10 includes a top flange portion 14 with two inwardly directed channels 16 and 18 bounding the upper surface 20 of the top flange portion 14. The two inwardly directed channels 16 and 18 partially enclose the upper surface 20 of the top flange portion 14 forming a recess 24 sized to receive the lower flange of a t-grid ceiling support 12. From the outside lower comer of adjacent channel 18 protrudes a diagonally downward extending lever 26. Rotation of the lever 26 causes the top flange portion 14 to be flexed, allowing the clip device 10 to engage over the lower flange of a t-grid ceiling support 12. Extending downward from the lower surface 22 of the top flange 14 is a curved lower jaw 30. The curved lower jaw 30 is operatively connected with the top flange portion 14 adjacent channel 18 and has a nominally free end 32 configured to form a jaw clasp 34 at the end of the clip device 10 adjacent channel 16. Additionally, a stationary clasp 36 depends generally downward from the lower surface 22 of the top flange portion 14, which is designed to selectively mate in an interlocking configuration with the jaw clasp 34 of the curved lower jaw 30. Further, the free end 32 of the curved lower jaw 30 contains an outwardly directed channel 38 opposite the jaw clasp 34 to assist in unlatching the jaw clasp 34 from the stationary clasp 36.

Figure 2:
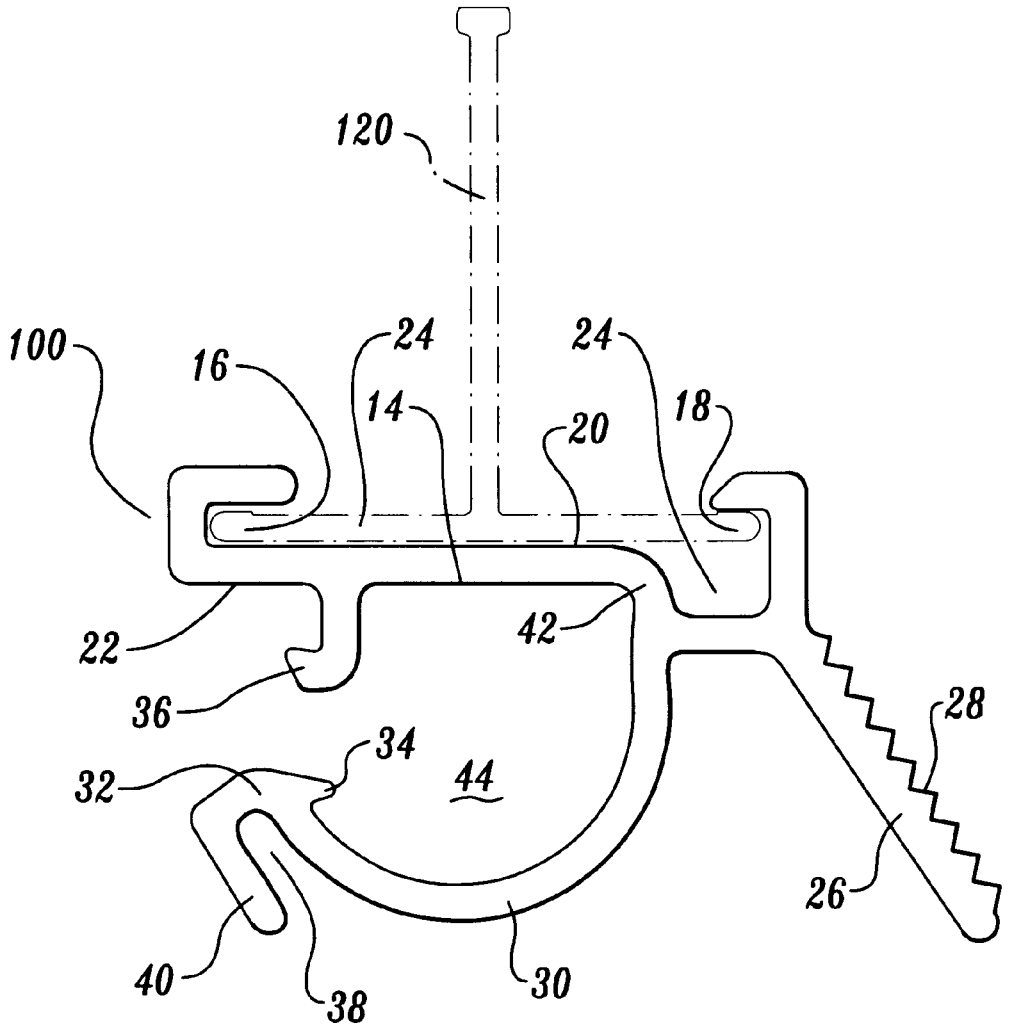
FIG. 2 illustrates a cross-sectional side view of an alternate embodiment of the present invention for a ceiling support structure t-grid of a smaller width, with the ceiling support structure t-grid shown in phantom.

As shown in FIG. 1, the curtain clip device 10 is designed to attach to the lower horizontal flange of a t-grid ceiling support 12. T-grid ceiling supports are contained in the ceiling structure of many buildings and are used as a framework to support acoustical ceiling tiles. The width of the lower horizontal flange of a standard t-grid ceiling support 12 is 15/16 ths of an inch. The curtain clip device 10 is configured to receive this 15/16" width. Another common width for the lower horizontal flange of a t-grid ceiling support 120 is 9/16 ths of an inch. As shown in FIG. 2, an alternate embodiment temporary curtain clip device 100 is designed to match this 9/16" width. This alternate embodiment temporary curtain clip device 100 is the same as the clip device 10 in all other aspects however.

Referring again to FIG. 1, the top flange portion 14 of the curtain clip device 10 is the section of the clip device that abuts against the bottom of the t-grid ceiling support 12. Specifically, the upper surface 20 of flange portion 14 is put into substantial face-to-face contact with the lower surface of the t-grid ceiling support 12 when the clip device 10 has been mounted. The upper surface 20 of the top flange 14 is bounded at each end by inwardly directed channels 16 and 18. These inwardly directed channels 16 and 18 partially enclose the upper surface 20, forming a recess 24. This recess 24 is occupied by the lower horizontal flange of the t-grid ceiling support 12 when the clip device 10 is mounted to the t-grid 12.

Referring to FIG. 2, a lever 26 is shown extending outwardly and downward from the outside lower comer of adjacent channel 18. In the preferred embodiment, the lever 26 extends diagonally downward at about a 45° angle, as shown in FIG. 2. It should be noted, however, that the lever 26 could extend solely outwardly with no downward angle, solely downward with no outward angle, or at any angle within that 90° range without departing from the scope of the present invention. It should also be noted that it is not necessary for the lever 26 to be attached to the outside lower comer of adjacent channel 18 as shown in FIG. 2. In an alternate embodiment of the present invention, the lever 26 could extend from any portion of adjacent channel 18. Additionally, in alternate embodiments of the present invention, the lever 26 could extend from adjacent channel 16 instead of adjacent channel 18. A further alternate embodiment could include levers 26 extending from both inwardly directed channels 16 and 18.

Figure 4:
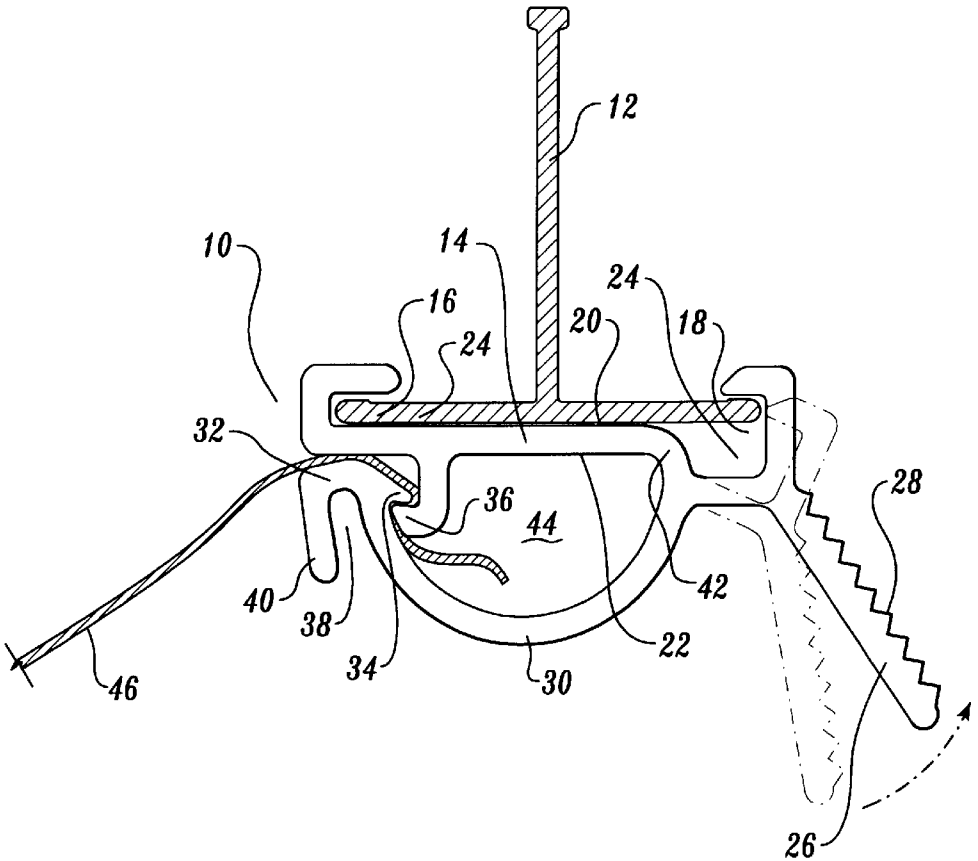
FIG. 4 illustrates a cross-sectional side view of the present invention of FIG. 1, installed on a ceiling support structure t-grid shown in cross-hatched lines and supporting a thin curtain, shown in cross-hatched lines.
Figure 3:
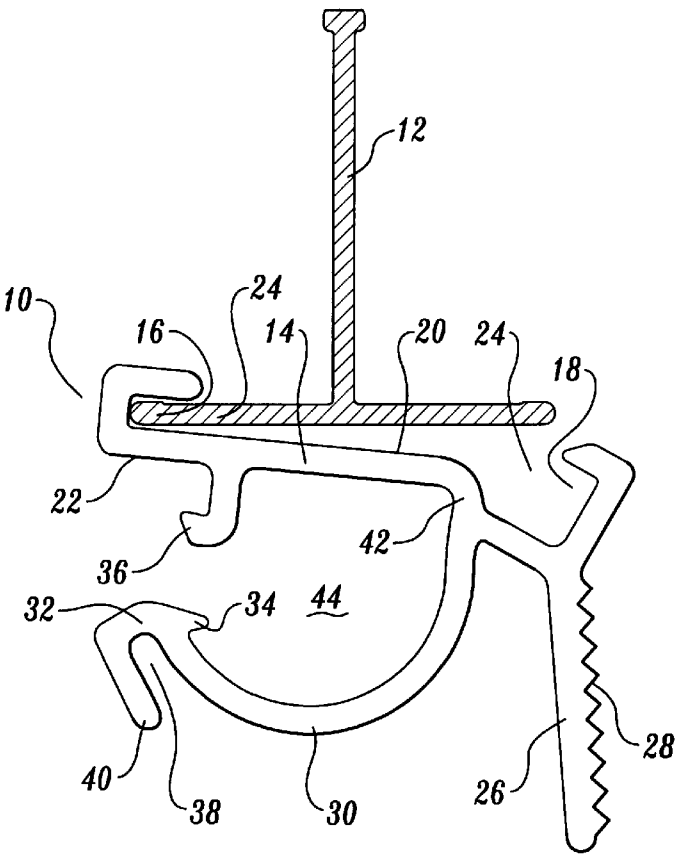
FIG. 3 illustrates a cross-sectional side view of the present invention of FIG. 1, with the top flange portion of the clip shown flexed to receive a ceiling support structure t-grid, shown in cross-hatched lines.

Referring again to FIG. 2, it can be seen that lever 26 has a serrated, or otherwise textured upper surface 28 to assist in rotation of the lever 26. As demonstrated in FIG. 3, clockwise rotation of the lever 26 causes the top flange portion 14 of the clip device 10 to be flexed such that the inwardly directed channels 16 and 18 separate enough to allow the lower horizontal flange of the t-grid ceiling support 12 to be inserted into the recess 24 created by the upper surface 20 of the top flange 14 and the two inwardly directed channels 16 and 18. When the clockwise manual pressure is removed from the lever 26, the top flange portion 14 unflexes back into substantially its original position, thereby securing the clip device 10 to the t-grid ceiling support 12, as shown in FIG. 4.

As should be readily apparent from the above description, the clip device 10 must be composed of a material flexible enough to allow and withstand the above-described deflection. As should also be readily apparent from the above description, the clip device 10 must be composed of a material resilient enough to substantially reassume its original shape after undergoing the above described deflection. Preferably, the clip device 10 is formed of a material with a modulus of elasticity such that the release lever 26 can be activated by finger pressure.

Referring again to FIG. 2, the curtain clip device further includes a curved lower jaw 30 that is generally semi-circular in shape. The curved lower jaw 30 extends downwardly from the lower surface 22 of the top flange 14. In a preferred embodiment, the curved lower jaw 30 has a fixed end 42 incorporated into the lower surface 22 of the top flange 14 near channel 18. From the fixed end 42, the lower jaw 30 curves generally downward, then continues curving towards channel 16, and at its free end 32, curves back in a generally upward direction. The generally semi-circular shape of the curved lower jaw 30 creates an interior cavity 44 in the area above the curved lower jaw 30 and below the top flange portion 14. The free end 32 of the curved lower jaw 30, to configured to form a jaw clasp 34.

As can also be seen in FIG. 1, the clip device 10 further contains stationary clasp 36 that extends generally downward from the lower surface 22 of the top flange 14 near channel 16. The stationary clasp 36 is positioned on the lower surface 22 of top flange 14 such that the stationary clasp 36 is selectively mateable with the jaw clasp 34 of curved lower jaw 30 in an interlocking configuration, through upward deflection of the curved lower jaw 30 relative to the top flange portion 14.

The free end 32 of the curved lower jaw 30 additionally includes a hook 40 that forms an outwardly directed channel 38 between the inner surface of the hook 40 and the outer surface of the curved lower jaw 30. The outwardly directed channel 38 is sized to receive a screwdriver blade or other similarly shaped object. Counterclockwise rotation of the screwdriver blade will result in the disengagement of the jaw clasp 34 from stationary clasp 36.

In a preferred embodiment of the present invention, the clip device 10 is constructed of a material with a flexibility and resilience that will allow the curved lower jaw 30 to be pushed upwards with finger pressure, causing the selective mating of the jaw clasp 34 and the stationary clasp 36, and allow the disengagement of the jaw clasp 34 from the stationary clasp 36 by way of insertion and counterclockwise rotation of a screwdriver blade or similarly shaped object in the outwardly directed channel 38. Disengagement of the selectively mated jaw clasp 34 and stationary clasp 36 results in the curved lower jaw 30 substantially returning to its original unmated position. Thus, allowing the curtain clip device 10 to be fully adjustable and reusable.

When the curved lower jaw 30 is in its open position (with jaw clasp 34 and stationary clasp 36 unlatched), a protective curtain 46 is inserted between the clasps 34 and 36 and into the interior cavity 44 of the clip device 10. Referring again to FIG. 4, the curved lower jaw 30 is then pushed upward, causing the interlocking of clasps 34 and 36 and securing the protective curtain 46 between them. Corresponding clasps 34 and 36 are adapted such that they can still achieve a secure interlocked mated position with the curtain 46 clamped between them.

Figure 5:
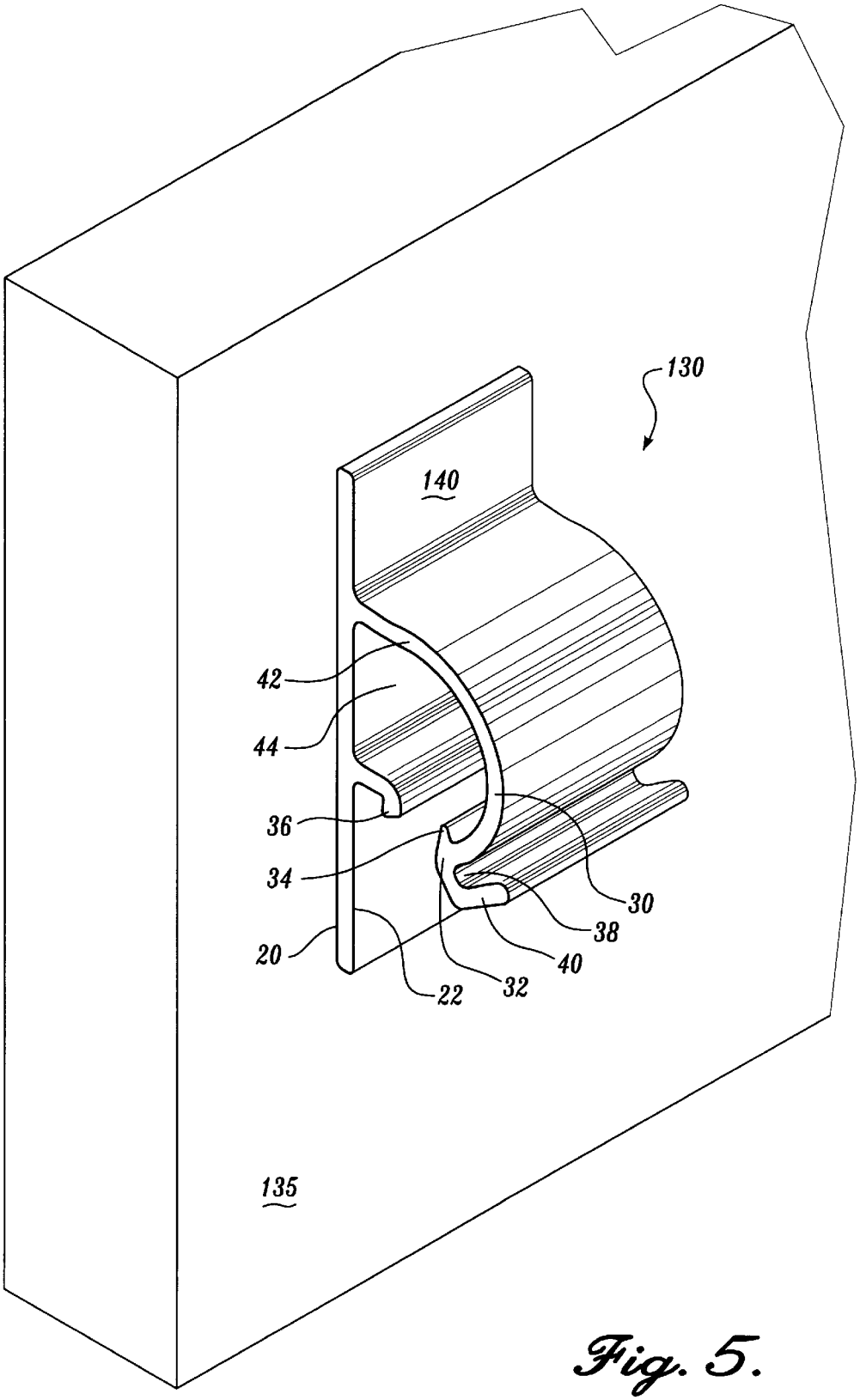
FIG. 5 illustrates an enlarged perspective view of an additional alternate embodiment of the present invention with a substantially flat top flange portion. The alternate embodiment is shown mounted on a vertical wall.

In the embodiment of the present invention shown in FIG. 5, another curtain clip device 130 is demonstrated as adapted to mount on a vertical wall 135 for situations where a t-grid ceiling support 12 is unavailable. The clip device 130 has a portion 140 that is substantially flat and contains no inwardly directed channels or diagonally depending levers. Instead, the substantially flat surface of the alternate flange portion 140 of the alternate clip device 130 is adhered directly to a vertical wall 135. The remaining features of this alternative clip device 130 are adapted and function in the same manner as the clip device 10 of the preferred embodiment.

All stated orientational language is provided merely for illustrative purposes and does not denote any intent to limit the present invention. The present invention has been described in relation to a preferred embodiment and several alternate embodiments. One of ordinary skill, after reading the foregoing specifications, may be able to effect variations, other changes, alterations, and substitutions or equivalents without departing from the broad concepts disclosed. It is therefore intended that the scope of the letters patent granted hereon be limited only by the definitions contained in the appended claims and equivalents thereof.

The embodiments of the invention in which an exclusive property or privilege is claimed are defined as follows:

1. A clip type device, comprising:

(a) a top flange portion, having a upper surface and a lower surface;

(b) two inwardly directed channels spaced apart on the upper surface of the top flange portion, the channels cooperating with the upper surface of the top flange portion to define a recess for receiving a support structure;

(c) a lower jaw portion extending downward from the lower surface of the top flange portion, and having a free end that defines a jaw clasp;

(d) a stationary clasp depending from the lower surface of the top flange portion and positioned to mate with the jaw clasp; and (e) the free end of the lower jaw portion configured to define an outwardly directed channel, the channel defining a recess for receiving a release tool, whereby facilitating disengagement of the jaw clasp from the stationary clasp, the clip type device defining an open, unlatched position by disengagement of the jaw clasp from the stationary clasp, and defining a closed, latched position by engagement of the jaw clasp from the stationary clasp.

2. The clip type device of claim 1, wherein the device is formed of a flexible material, whereby the top flange portion can be flexed to engage a ceiling tile support t-grid, and the lower jaw portion can be flexed to latch the jaw clasp to the stationary clasp.

3. The clip type device of claim 1, wherein the device is formed of a resilient material, whereby the top flange portion will substantially reassume its original shape after being flexed to engage a ceiling tile support t-grid, and the lower jaw portion will substantially reassume its original shape after being flexed to latch the jaw clasp to the stationary clasp.

4. The clip type device of claim 1, wherein at least one downwardly extending lever is operatively associated with at least one of the channels.

5. The clip type device of claim 4, wherein said at least one downwardly extending lever extends generally diagonally downward from said at least one operatively associated channel.

6. The clip type device of claim 4, wherein said lever further comprises an upper surface which is serrated, notched, or otherwise textured for enhanced gripping capability, whereby facilitating flexing of the top flange portion to engage or disengage a ceiling tile support t-grid.

7. The clip type device of claim 1, wherein the width of the outwardly directed channel of the lower jaw portion is adapted to be sized or signable to receive a screwdriver blade or similarly shaped object, whereby the jaw clasp can be priably released from the stationary clasp.

8. The clip type device of claim 1, wherein a thin sheet of material is insertable between the jaw clasp and the stationary clasp, with the clip device in the open unlatched position.

9. The clip type device of claim 1, wherein a thin sheet of material is securable between the jaw clasp and the stationary clasp, with the clip device in the closed latched position.

10. A clip-type device for facilitating securing a thin sheet of curtain-like material to a ceiling channel support flange, comprising:

a horizontal, substantially flat main body section, having a top surface and a bottom surface;

flange engagement means operatively connected to the top surface of the main body section for selective engagement with a ceiling channel support flange;

a yieldable curved lower jaw section extending from the bottom surface of the main body section to terminate at a free end portion, the lower jaw section defining an interior cavity between the main body section and the yieldable lower jaw;

means for securing a thin sheet of material in the yieldable lower jaw utilizing a clasp extending from the main body portion and configured to engage with the free end of the lower jaw section, and the free end of the lower jaw having portions defining an outwardly directed hook, the hook having a slot for receiving a screwdriver blade-type instrument, whereby the free end of the jaw can be manually disengaged from the clasp, the clip-type device having an open, unlatched position defined by disengagement of the free end of the jaw from the clasp, and a closed, latched position defined by engagement of the free end of the jaw to the clasp, and wherein the device is formed of a flexible material, whereby the top flange portion can be flexed to engage a ceiling tile support t-grid, and the lower jaw portion can be flexed to engage the free end of the jaw to the clasp.

11. The clip type device of claim 10, wherein the device is formed of a resilient material, whereby the top flange portion will substantially reassume its original shape after being flexed to engage, and the free end of the jaw will substantially reassume its original position after being flexed to engage with the clasp.

12. A clip-type device for facilitating securing a thin sheet of curtain-like material to a ceiling channel support flange, comprising:

a horizontal, substantially flat main body section, having a top surface and a bottom surface;

flange engagement means operatively connected to the top surface of the main body section for selective engagement with a ceiling channel support flange;

a yieldable curved lower jaw section extending from the bottom surface of the main body section to terminate at a free end portion, the lower jaw section defining an interior cavity between the main body section and the yieldable lower jaw;

means for securing a thin sheet of material in the yieldable lower jaw utilizing a clasp extending from the main body portion and configured to engage with the free end of the lower jaw section, and the free end of the lower jaw having portions defining an outwardly directed hook, the hook having a slot for receiving a screwdriver blade-type instrument, whereby the free end of the jaw can be manually disengaged from the clasp, the clip-type device having an open, unlatched position defined by disengagement of the free end of the jaw from the clasp, and a closed, latched position defined by engagement of the free end of the jaw to the clasp, and wherein a downwardly extending lever is integral with the main body section.

13. The clip type device of claim 12, wherein said lever extends generally diagonally downward from the main body section.

14. The clip type device of claim 12, wherein said lever further comprises an upper surface which is serrated, notched, or otherwise textured for enhanced gripping capability, whereby facilitating the flexing of the main body section to engage or disengage a ceiling channel support flange.

* * * * *